US006542851B2

(12) United States Patent
Hasegawa et al.

(10) Patent No.: US 6,542,851 B2
(45) **Date of Patent: *Apr. 1, 2003**

(54) METHOD AND APPARATUS FOR MEASURING COMPONENT PERFORMANCE DATA OF CONSTRUCTION MACHINE

(75) Inventors: Nobuki Hasegawa, Tochigi (JP); Yukio Sugano, Tochigi (JP); Shigeru Yamamoto, Osaka (JP)

(73) Assignee: Komatsu Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/320,157

(22) Filed: May 26, 1999

(65) Prior Publication Data

US 2002/0103623 A1 Aug. 1, 2002

(30) Foreign Application Priority Data

Jul. 6, 1998 (JP) ..... 10-190110
Jun. 2, 1998 (JP) ..... 10-152834

(51) Int. Cl.[7] ..... G06F 15/00; G06F 11/30
(52) U.S. Cl. ..... 702/182; 701/29
(58) Field of Search ..... 702/33, 35, 108, 702/113–115, 50, 121–123, 127, 130, 138, 145, 176–178, 182–185, 188; 701/29, 31, 32, 35

(56) References Cited

U.S. PATENT DOCUMENTS 4,241,403 A * 12/1980 Schultz ..... 701/35
4,441,359 A * 4/1984 Ezoe ..... 73/117
4,542,461 A * 9/1985 Eldridge et al. ..... 701/35
4,656,586 A * 4/1987 Ochiai et al. ..... 701/33
5,524,078 A * 6/1996 Kolb et al. ..... 701/29
5,531,122 A * 7/1996 Chatham et al. ..... 73/760
5,550,737 A * 8/1996 Tedeschi ..... 701/31
5,592,614 A * 1/1997 Peters ..... 714/26
5,673,017 A * 9/1997 Dery et al. ..... 340/426
5,787,378 A * 7/1998 Schricker ..... 701/50
5,950,144 A * 9/1999 Hall et al. ..... 702/108

FOREIGN PATENT DOCUMENTS

JP 10-273920 10/1998

OTHER PUBLICATIONS

Mitsuo Takahashi, "Handy Reference to Computing Terms", publ. Natsume Sha, Japan, 1989.
Anthony Ralston and Edwin D. Reilly, ed., "Encyclopedia of Computer Science", Van Nostrand Reinhold, New York, USA, 1993, p. 698.

* cited by examiner

*Primary Examiner*—Marc S. Hoff
*Assistant Examiner*—Manuel L. Barbee
(74) *Attorney, Agent, or Firm*—Frishauf, Holtz, Goodman & Chick, P.C.

(57) ABSTRACT

Performance data of components of a construction machine is measured by the steps of automatically operating the component mounted to the construction machine so as to satisfy one of a plurality of measurement conditions which are preliminarily set, automatically measuring performance data of the component which is preliminarily set under the above automatically operated state, and successively performing the same steps as those defined above with respect to remaining measurement conditions other than the above-mentioned one measurement condition, thus measuring the performance data of the component with one or more than one measurement conditions.

12 Claims, 6 Drawing Sheets

METHOD AND APPARATUS FOR MEASURING COMPONENT PERFORMANCE DATA OF CONSTRUCTION MACHINE

BACKGROUND OF THE INVENTION

1. Field of the Invention

The present invention relates to method and apparatus for measuring performance data of components of a construction machine such as engine, speed changing mechanism, brake and hoist cylinder of a dump truck, or torque converter, speed changing mechanism, steering clutch, brake and hydraulic mechanisms of a bulldozer.

2. Background Art

With a construction machine, for example, a dump truck, performance data of various components or mechanisms such as engine, speed changing mechanism, brake, hoist cylinder and the like are periodically measured. According to the changes of the obtained data, the conditions of the respective components are judged, possibility of occurrence of accidents or faults, which may occur thereafter, is preliminarily estimated, and the components are preliminarily repaired or parts thereof are exchanged in advance to prevent such estimated accidents or faults from occurring.

In order to measure the performance data of such various components, a worker or operator connects a tester or measuring means to a part of the component to be measured an manually handles the component so as to satisfy conditions for the measurement of the part to be measured and accordingly, such operation or handling involves much troublesome working.

SUMMARY OF THE INVENTION

The present invention was conceived to improve the defects or drawbacks encountered in the prior art mentioned above and an object of the present invention is therefore to provide method and apparatus for measuring performance data of components of a construction machine.

A first aspect for achieving the above object is to provide a method of measuring performance data of a component of a construction machine comprising the steps of:

- automatically operating the components mounted to the construction machine so as to satisfy one of a plurality of measurement conditions which are preliminarily set;
- automatically measuring performance data of the components set under the above automatically operated state; and
- successively performing the same steps as those defined above with respect to remaining measurement conditions other than the above-mentioned one measurement condition thereby to measure the performance data of the components with one or more than one measurement conditions.

According to this first aspect, the component of the construction machine can automatically operate so as to satisfy the measurement conditions, and the performance data of the component can be automatically measured with such measurement conditions, whereby the measuring working can be made easy.

A second aspect of the present invention is to provide a method of measuring performance data of a component of a construction machine according to the first aspect 1, wherein the measured performance data is sent to a remote place apart from the construction machine and an abnormal condition is displayed on the remote place at a time when the measured performance data is different from a normal performance data.

According to this second aspect, it is known whether the measured data is normal or abnormal at a remote place apart from the construction machine. Therefore, it becomes possible to know abnormality of the measured data of a plurality of construction machines at a remote place apart from the construction machines and, hence, a plurality of construction machines can be managed in a centralized manner.

A third aspect of the present invention is to provide a method of measuring performance data of a component of a construction machine according to the first aspect, wherein the measured data of components of one or more than one construction machines are sent to a remote place every one construction machine and the measured performance data of the components of the respective construction machines are totally processed and stored in the remote place.

According to this third aspect, the following advantageous effects will be achieved.

That is, in an environment at which a plurality of construction machines different in types are worked in set, the construction machines are interspersed and worked independently in a wide area, and in such case, workers who perform inspection or maintenance of the machines are required to have much time and labour in order to contact and operate the set of the construction machines worked at various positions. In such working environment, it is generally required for the construction machines to be operated with high working performance and efficiency, and for example, it is extremely necessary to prevent occurrence of such event or failure that the construction machine is out of order and is not worked. In order to prevent such event or failure, it is necessary to perform a periodical inspection or service. However, only in performing the predetermined service every predetermined engine working time or travelling distance, it is hard to say that such service or inspection is complete or satisfied because the life times of the construction machines are different in their loads in use or using environments.

In view of above facts, in the first aspect of the present invention, since the measurement of the performance data of the component of the construction machine is performed automatically, the measurement of the performance data can be done by the operator of the construction machine without the maintenance worker going to the construction machine. In addition, in the third aspect of the present invention mentioned above, the performance data can be collected and stored in one base through a preferred communication means, so that the maintenance worker or management representative of the construction machines can know the performance data of a plurality of construction machines without moving their positions. Such data are accumulated and analyzed in any time series method thereby to estimate the time at which the components or parts of the construction machines are to be overhauled or exchanged to obviate an occurrence of faults. In this view point, the measurement data in the present invention are ones which are measured under the quite same conditions set automatically, so that such time series analysis can be effectively performed and provides high reliability.

A fourth aspect of the present invention is to provide an apparatus for measuring performance data of an component of a construction machine comprising:

- means for detecting performance data of components mounted to the construction machine;
- means for storing a plural sets of measurement signals and control signals for realizing measurement conditions corresponding to the plural sets of measurement signals;

control means for outputting automatically successively, to the components, a set of measurement signals and control signals creating states for satisfying the measurement conditions corresponding to the set of the measurement signals with reference to the means for storing, to obtain performance data, and successively performing the same operation with respect to the remaining sets of measurement signals and control signals, when measurement starting signal is inputted into the control means; and means for inputting the measurement starting signal to the control means.

According to this fourth aspect, when the measurement starting signal is inputted into the control means, the control means successively measures the performance data in conditions coincident with the predetermined measurement conditions. Therefore, the performance data of the respective components of the construction machine can be measured only through the inputting of the measurement starting signal.

A fifth aspect of the present invention is to provide an apparatus for measuring performance data of a component of a construction machine according to the fourth aspect, which further comprises a communication means for inputting the measurement starting signal to the control means from a remote place apart from the construction machine.

According to this fifth aspect, the measurement can be started by transmitting the measurement starting signal from the remote place apart from the construction machine.

A sixth aspect of the present invention is to provide an apparatus for measuring performance data of a component of a construction machine according to the fourth aspect, which further comprises:

a communication means for transmitting and receiving the measured performance data to and from a remote place apart from the construction machine;

a data processing means for processing the performance data received by the communication means so as to provide a form to be displayed;

means for displaying the measured performance data processed by the data processing means; and means arranged in operative association with the data processing means and adapted to store the measured performance data.

In this sixth aspect, the measured performance data can be transmitted to a remote place apart from the construction machine, and accordingly, for example, the construction machine can be managed at a base apart from a place at which the construction machine is worked.

A seventh aspect of the present invention is to provide an apparatus for measuring performance data of a component of a construction machine according to the above fifth or sixth aspect, which further comprises a data processing means adapted to judge to be abnormal in a case where the measured performance data differs from a correct (normal) performance data and a display means for displaying a fact of the abnormal condition when judged as being abnormal.

According to this seventh aspect, the fact that the measured performance data is abnormal can be visually observed.

An eighth aspect of the present invention is to provide an apparatus for measuring performance data of a component of a construction machine according to the above sixth aspect, wherein the communication means for transmitting and receiving the measured performance data to and from a remote place apart from the construction machine generates transmission data in combination of the measured data and data other than the measured data such as vehicle type identification number, year, month, day and time of the measuring, engine total working time and groups of measured conditions.

In this eighth aspect, since the transmission data includes the vehicle type identification number, year, month, day and time of the measuring, engine total working time and groups of measured conditions, the respective data can be easily arranged and managed.

A ninth aspect of the present invention is to provide an apparatus for measuring performance data of a component of a construction machine according to the above eighth aspect, wherein the transmission data is used as centralized management data of the construction machine.

According to this ninth aspect, the transmission data is utilized for the centralized management data of the construction machine, so that the construction machine groups working at various positions in a wide area can be concentrically managed and controlled.

BRIEF DESCRIPTION OF THE DRAWINGS

The present invention will be made more understandable by way of the following detailed description and accompanying drawings showing exemplary embodiments of the present invention. Further, the embodiments shown in the accompanying drawings do not specify the invention and are for the explanation of the invention and easy understanding thereof.

In the accompanying drawings.

DESCRIPTION OF THE PREFERRED EMBODIMENTS

The method and apparatus for measuring data of performance of components of a construction machine according to the present invention will be described hereunder with reference to the accompanying drawings.

First, one embodiment for measuring performance data of components of a dump truck will be described.

Figure 1:
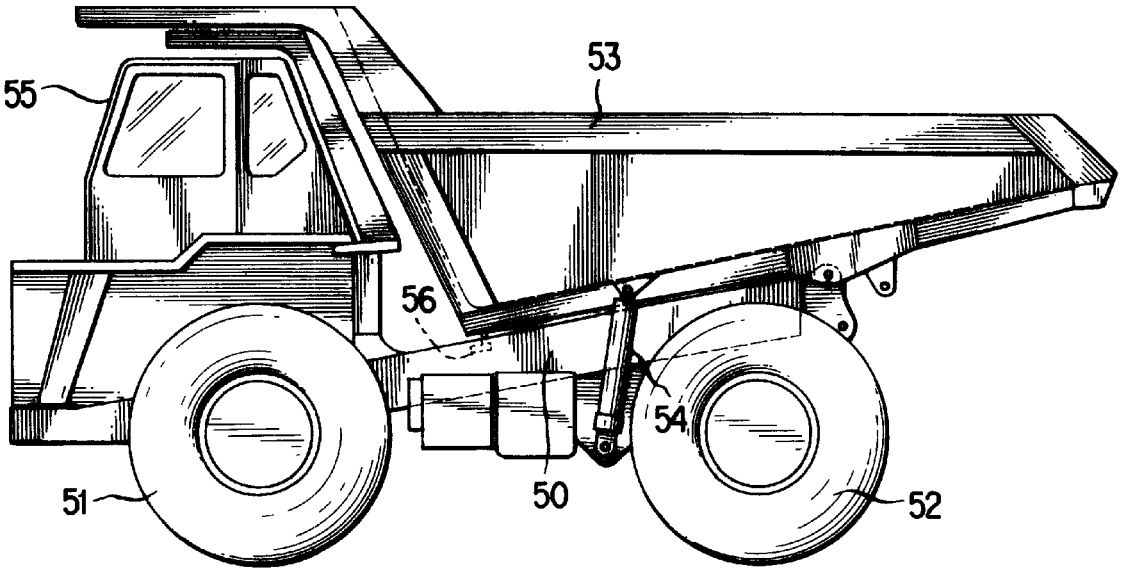
FIG. 1 is a schematic side view of a dump truck to which the present invention is applicable.

FIG. 1 is a schematic side view of a dump truck, which has a truck body 50 to which a steering wheels 51 and a driving wheels 52 are attached, and a vessel 53 is mounted to the truck body 50 to be moved up and down by means of a hoist cylinder 54. The steering wheels 51 are steered by a steering cylinder, not shown. The truck body 50 is provided with an operation chamber, i.e. driver's room, 55 to which an acceleration pedal, a parking lever, an emergency lever, a steering handle, a sand (stone) discharge lever, etc., which are all described hereinlater, are arranged.

Figure 2:
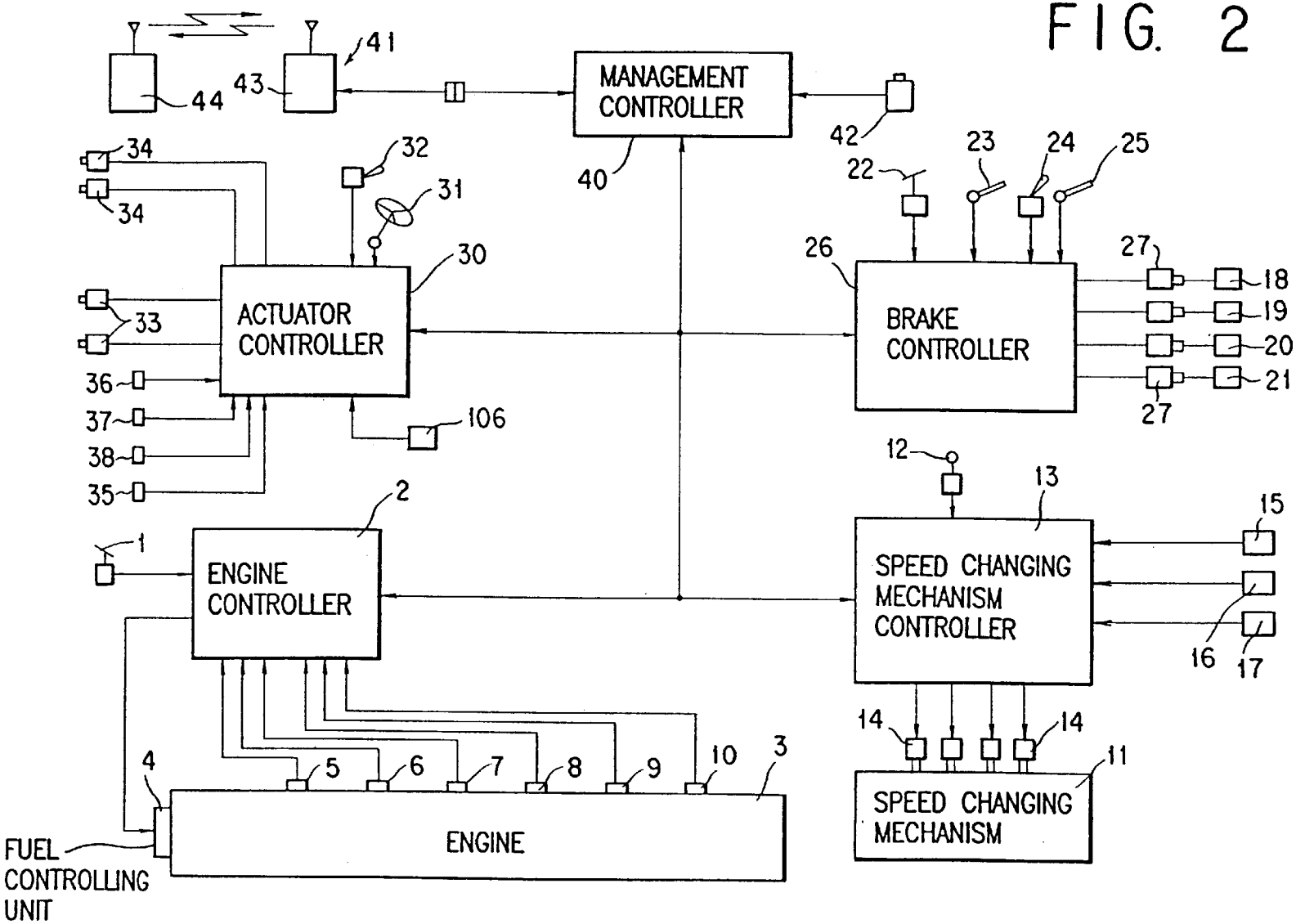
FIG. 2 is block diagram showing an arrangement of a measuring apparatus according to the present invention.

With reference to FIG. 2, when the acceleration pedal 1 is footed, a footing amount is inputted into an engine controller 2, from which signals of engine rotation number (revolution speed) command and fuel injection amount command in accordance with the inputted pedal footing amount are then outputted to a fuel controlling unit 4 of an engine thereby to drive the engine 3 at an engine rotation number or speed corresponding to the footing amount of the acceleration pedal 1.

To the engine 3 are connected an engine rotation sensor 5, an engine oil pressure sensor 6, a blow-by pressure sensor 7, a boost pressure sensor 8, an exhaust gas temperature sensor 9, and an air cleaner inlet temperature sensor 10, and data measured by the above respective sensors are inputted into the engine controlling unit 2 as engine performance data.

An output from the engine 3 is inputted to a speed changing mechanism 11 through a torque converter, and a speed changing command from a shift lever 12 is inputted into a speed changing mechanism controller 13 to electrically control a clutch solenoid 14 of the speed changing mechanism 11 thereby to set the speed changing mechanism at speed stages corresponding to the speed changing command inputted.

Furthermore, a torque converter oil temperature, a hydraulic pump pressure for the speed changing mechanism and a rotation number of an output shaft of the speed changing mechanism are inputted to the speed changing mechanism controller 13, respectively, from a torque converter oil temperature sensor 15, an oil pressure sensor 16 for the speed changing mechanism disposed to a drain passage of the oil pressure pump for the speed changing mechanism and a rotation number sensor 17 for the output shaft of the speed changing mechanism.

The output of the speed changing mechanism 11 is transmitted to the driving wheels 52 through a differential mechanism. The braking of the dump truck is carried by a parking brake 18, a service brake 19, a retarder brake 20, and an emergency brake 21.

Respective braking signals are inputted into a brake controller 26 from a brake pedal 22, a retarder lever 23, a parking lever 24 and an emergency lever 25, and the brake controller 26 electrically energizes respective brake solenoids 27 thereby to establish braked or unbraked conditions of the respective brakes.

Operations of actuators such as steering cylinder and hoist cylinder are controlled by an actuator controller 30, and when a steering angle signal from the steering handle 31 and a sand discharge signal form the sand discharge lever 32 are inputted into the actuator controller 30, a steering solenoid 33 of a steering valve and a solenoid 34 of a hoist valve are electrically controlled so as to extend or contract the steering cylinder and the hoist cylinder thereby to perform a steering operation and a sand discharge operation.

To the actuator controller 30, there are respectively inputted a steering angle from a steering sensor 35 such as steering cylinder expansion/contraction amount sensor or actual steering angle sensor, a steering hydraulic pump pressure from a steering oil pressure sensor 36 disposed to a drain passage of the steering hydraulic pump, a vessel angle from a vessel angle sensor 37 such as hoist cylinder expansion/contraction amount sensor or vessel angle sensor, and a hoist cylinder hydraulic pump pressure from a hoist cylinder oil pressure sensor 38 disposed to a discharge passage of a hoist cylinder hydraulic pump.

Measurement starting signals from a communication means 41 and a manual switch 42 are inputted into a management controller 40. The communication means 41 is provided with a truck body side transmitter-receiver 43 and a remote side transmitter-receiver 44 so that the measurement starting signal can be inputted into the management controller 40 from a portion apart from the dump truck through a wireless communication.

The management controller 40 outputs, when inputted with the measurement starting signal, measurement signals to the respective controllers in a predetermined order and the measured data is transmitted to a remote place through the communication means 41. Further, the measured data may be stored in the management controller 40.

The operation of the measuring system in the arrangement shown in FIG. 2 will be described hereunder.

When the measurement starting signal is inputted into the management controller 40, first measurement signals are inputted into the engine controller 2, the speed changing mechanism controller 13 and the brake controller 26.

In response to the first measurement signals, the engine controller 2 generates an engine low speed idling signal to make the engine 3 in a low speed idling state, the speed changing mechanism controller 13 generates a speed changing mechanism neutral signal to make the speed changing mechanism 11 in a neutral state, and the brake controller 26-generates a parking brake operation signal to make the parking brake 18 in a braking state.

Under the states mentioned above, a signal representing the engine rotation number (revolution speed) detected by the engine rotation sensor 5 is inputted into the management controller 40 as an engine low speed idling rotation number, which is then measured.

Upon the completion of the measurement of the engine low speed idling rotation number, the management controller 40 inputs second measurement signals to the engine controller 2, the speed changing mechanism controller 13 and the brake controller 26, respectively.

In response to the second measurement signals, the engine controller 2 generates an engine high speed idling signal to make the engine 3 in a high speed idling state, the speed changing mechanism controller 13 generates a speed changing mechanism neutral signal to make the speed changing mechanism 11 in a neutral state, and the brake controller 26 generates a parking brake operation signal to make the parking brake 18 in a braking state.

Under the states mentioned above, a signal representing the engine rotation number detected by the engine rotation sensor 5 is inputted into the management controller 40 as an engine high speed idling rotation number, which is then measured.

Upon the completion of the measurement of the engine high speed idling rotation number, the management controller 40 inputs third measurement signals to the engine controller 2, the speed changing mechanism controller 13 and the brake controller 26, respectively.

In response to the third measurement signals, the engine controller 2 generates an engine high speed signal to make the engine 3 in a high speed rotating state, the speed changing mechanism controller 13 generates a travelling (running) signal to make the speed changing mechanism 11 in a running state, and the brake controller 26 generates a parking brake signal and a service brake signal to make the parking brake 18 and the service brake 19 in braking states.

Under the states mentioned above, a signal representing the torque converter oil temperature measured by the torque converter oil temperature sensor 15 and a signal representing the engine rotation number detected by the engine rotation sensor 5 are inputted into the management controller 40 thereby to measure the engine rotation number at a time that the torque converter oil temperature is a set temperature as a torque converter stool rotation number.

Upon the completion of the measurement of the torque converter stool rotation number, the management controller 40 inputs fourth measurement signals to the engine controller 2, the speed changing mechanism controller 13 and the brake controller 26, respectively.

In response to the fourth measurement signals, the engine controller 2 generates an engine high speed signal to make the engine 3 in a high speed rotating state, the speed changing mechanism controller 13 generates a travelling (running) signal to make the speed changing mechanism 11 in a running state, and the brake controller 26 generates a parking brake signal and a service brake signal to make the parking brake 18 and the service brake 19 in braking states.

Under the states mentioned above, a signal representing the blow-by pressure detected by the blow-by sensor 7 and the torque converter oil temperature detected by the torque converter oil temperature sensor 15 are inputted into the management controller 40 thereby to measure the blow-by pressure at a time that the torque converter oil temperature is a set temperature.

Upon the completion of the measurement of the blow-by pressure, the management controller 40 inputs fifth measurement signals to the engine controller 2, the speed changing mechanism controller 13 and the brake controller 26, respectively.

In response to the fifth measurement signals, the engine controller 2 generates an engine high speed signal to make the engine 3 in a high speed rotating state, the speed changing mechanism controller 13 generates a speed changing mechanism neutral signal to make the speed changing mechanism 11 in a neutral state, and the brake controller 26 generates a parking brake signal to make the parking brake 18 in braking states.

Under the states mentioned above, a signal representing an engine oil pressure detected by the engine oil pressure sensor 6 is inputted into the management controller 40 as engine lubrication oil (lubricant) pressure thereby to measure an engine lubricant pressure at the time of the engine high speed rotation operation. In the like manner, an engine lubricant pressure at the time of the engine low speed idling operation will be measured by making the engine 3 in the low speed idling state.

Upon the completion of the measurement of the engine lubricant pressure, the management controller 40 inputs sixth measurement signals to the engine controller 2, the speed changing mechanism controller 13 and the brake controller 26, respectively.

In response to the sixth measurement signals, the engine controller 2 generates an engine high speed signal to make the engine 3 in a high speed rotating state, the speed changing mechanism controller 13 generates a traveling (running) signal to make the speed changing mechanism 11 in a running state, and the brake controller 26 generates a parking brake signal and a service brake signal to make the parking brake 18 and the service brake 19 in braking states.

Under the states mentioned above, a signal representing the boost pressure detected by the boost pressure sensor 8 and a signal representing the torque converter oil temperature measured by the torque converter oil temperature sensor 15 are inputted into the management controller 40 thereby to measure the boost pressure at the time that the torque converter temperature is a set temperature.

Upon the completion of the measurement of the engine boost pressure, the management controller 40 inputs seventh measurement signals to the engine controller 2, the speed changing mechanism controller 13 and the brake controller 26, respectively.

In response to the seventh measurement signals, the engine controller 2 generates an engine high speed signal to make the engine 3 in a high speed rotating state, the speed changing mechanism controller 13 generates a speed changing mechanism neutral signal to make the speed changing mechanism 11 in a neutral state, and the brake controller 26 generates a parking brake signal to make the parking brake 18 in braking states.

Under the states mentioned above, a signal representing an exhaust gas temperature detected by the exhaust gas temperature sensor 9 and a signal representing an air cleaner inlet temperature detected by the air cleaner inlet temperature sensor 10 are inputted into the management controller 40 thereby to measure the exhaust gas temperature and the air cleaner inlet temperature, respectively.

Upon the completion of the measurement of the above-mentioned temperatures, the management controller 40 inputs eighth measurement signals to the engine controller 2, the speed changing mechanism controller 13 and the brake controller 26, respectively.

In response to the eighth measurement signals, the engine controller 2 generates an engine low speed idling signal to make the engine 3 in a low speed idling state, the speed changing mechanism controller 13 generates a speed changing mechanism neutral signal to make the speed changing mechanism 11 in a neutral state, and the brake controller 26 generates a parking brake signal to make the parking brake 18 in a braking state.

Under the states mentioned above, a signal representing a hydraulic pump pressure for the speed changing mechanism detected by the speed changing mechanism oil pressure sensor 16 is inputted into the management controller 40, and this hydraulic pump pressure does not exceed a certain value, this value is measured and determined as a main relief pressure of a main relief valve arranged to a drain passage of the hydraulic pump for the speed changing mechanism. In the like manner, a main relief pressure will be measured by rotating the engine at high speed.

Upon the completion of the measurement of the main relief pressure, the management controller 40 inputs ninth measurement signals to the engine controller 2, the speed changing mechanism controller 13 and the brake controller 26, respectively.

In response to the ninth measurement signals, the engine controller 2 generates an engine high speed signal to make the engine 3 in a high speed rotating state, the speed changing mechanism controller 13 generates a speed changing mechanism neutral signal to make the speed changing mechanism 11 in a neutral state, and the brake controller 26 generates a parking brake signal to make the parking brake 18 in a braking state. Furthermore, the actuator controller 30 generates a maximum steering angle signal to operate the steering cylinder by its maximal extendable amount thereby to create the maximum steering state.

Under the states mentioned above, a signal representing a hydraulic pump pressure for the steering operation detected by the steering oil pressure sensor 36 is inputted into the management controller 40, and when the measured pressure does not exceed a certain value, this pressure value measured and determined as a main relief pressure of a main relief valve arranged to a drain passage of the steering hydraulic pump. In the like manner, a main relief pressure will be measured by rotating the engine at high speed.

Upon the completion of the measurement of the main relief pressure mentioned above, the management controller 40 inputs tenth measurement signals to the engine controller 2, the speed changing mechanism controller 13 and the brake controller 26, respectively.

In response to the tenth measurement signals, the engine controller 2 generates an engine acceleration signal to gradually change the engine rotation speed from the low speed to high rotation speed, the speed changing mechanism controller 13 generates a traveling (running) signal to make the speed changing mechanism 11 in a running state, and the brake controller 26 generates a service brake signal to make the service brake 19 in a braking state.

Under the states mentioned above, a signal representing the engine rotation number detected by the engine rotation number sensor 5 and a signal representing a rotation number of an output shaft of the speed changing mechanism detected by the output rotation number sensor 17 are inputted into the management controller 40 thereby to measure the engine rotation number at a time that the output shaft of the speed changing mechanism begins to rotate and the measured value is determined as a braking force of the service brake 19 at that time.

Upon the completion of the measurement of the service braking force, the management controller 40 inputs eleventh measurement signals to the engine controller 2, the speed changing mechanism controller 13 and the brake controller 26, respectively.

In response to the eleventh measurement signals, the engine controller 2 generates an engine acceleration signal to gradually change the engine rotation speed from the low speed to high rotation speed, the speed changing mechanism controller 13 generates a traveling (running) signal to make the speed changing mechanism 11 in a running state, and the brake controller 26 generates a retarder brake signal to make the retarder brake 20 in a braking state.

Under the states mentioned above, a signal representing the engine rotation number detected by the engine rotation number sensor 5 and a signal representing a rotation number of an output shaft of the speed changing mechanism detected by the output rotation number sensor 17 are inputted into the management controller 40 thereby to measure the engine rotation number at a time that the output shaft of the speed changing mechanism begins to rotate and the measured value is determined as a braking force of the retarder brake 20 at that time.

Upon the completion of the measurement of the retarder braking force, the management controller 40 inputs twelfth measurement signals to the engine controller 2, the speed changing mechanism controller 13 and the brake controller 26, respectively.

In response to the twelfth measurement signals, the engine controller 2 generates an engine acceleration signal to gradually change the engine rotation speed from the low speed to high speed, the speed changing mechanism controller 13 generates a traveling (running) signal to make the speed changing mechanism 11 in a running state, and the brake controller 26 generates an emergency brake signal to make the emergency brake 21 in a braking state.

Under the states mentioned above, a signal representing the engine rotation number detected by the engine rotation number sensor 5 and a signal representing a rotation number of an output shaft of the speed changing mechanism detected by the output shaft rotation number sensor 17 are inputted into the management controller 40 thereby to measure the engine rotation number at a time that the output shaft of the speed changing mechanism begins to rotate and the measured value is determined as a braking force of the emergency brake 21 at that time.

Upon the completion of the measurement of the emergency braking force, the management controller 40 inputs thirteenth measurement signals to the engine controller 2, the speed changing mechanism controller 13 and the brake controller 26, respectively.

In response to the thirteenth measurement signals, the engine controller 2 generates an engine low speed signal to make the engine 3 in a low speed rotating state, the speed changing mechanism controller 13 generates a speed changing mechanism neutral signal to make the speed changing mechanism 11 in a neutral state, and the brake controller 26 generates a parking brake signal to make the parking brake 18 in a braking state. Furthermore, the actuator controller 30 generates a vessel lift-up signal to carry out the extension operation of the hoist cylinder to lift up the vessel of the dump truck.

Under the states mentioned above, a signal representing a hydraulic pump pressure for the hoist cylinder detected by the hoist cylinder oil pressure sensor 38 is inputted into the management controller 40, and the hoist pressure is then measured. In the like manner, the oil pressure of the hoist cylinder hydraulic pump at the time of the engine high speed rotation period is measured.

Upon the completion of the measurement of the hydraulic pump pressure for the hoist cylinder, the management controller 40 inputs fourteenth measurement signals to the engine controller 2, the speed changing mechanism controller 13 and the brake controller 26, respectively.

In response to the fourteenth measurement signals, the engine controller 2 generates an engine high speed signal to make the engine 3 in a high speed rotating state, the speed changing mechanism controller 13 generates a speed changing mechanism neutral signal to make the speed changing mechanism 11 in a neutral state, and the brake controller 26 generates a parking brake signal to make the parking brake 18 in a braking state. Furthermore, the actuator controller 30 generates a vessel lift-up signal to carry out the extension operation of the hoist cylinder to lift up the vessel of the dump truck.

Under the states mentioned above and as shown in FIG. 1, a signal of a seating switch 56 operating at a time when the vessel 53 is separated (lifted up) from the truck body 50 and a signal representing a pressure of the oil pressure sensor 38 for the hoist cylinder are inputted into the management controller 40, and a time interval from the inputting of the signal of the seating switch 56 to the starting of the relief operation of the main relief valve mentioned hereinbefore is measured. According to this measured time, the lift-up speed of the vessel 53 is calculated and measured.

Upon the completion of the measurement of the vessel lift-up speed, the management controller 40 inputs fifteenth measurement signals to the engine controller 2, the speed changing mechanism controller 13 and the brake controller 26, respectively.

In response to the fifteenth measurement signals, the engine controller 2 generates an engine high speed signal to make the engine 3 in a high speed rotating state, the speed changing mechanism controller 13 generates a speed changing mechanism neutral signal to make the speed changing mechanism 11 in a neutral state, and the brake controller 26 generates a parking brake signal to make the parking brake 18 in a braking state. Furthermore, the actuator controller 30 generates a vessel lift-up signal to carry out the extension operation of the hoist cylinder to lift up the vessel of the dump truck. At the vessel lift-up time, a vessel angle signal is generated from the vessel angle sensor 37, and at a time when the vessel angle becomes to a set valve, the generation of the vessel lift-up signal is stopped. A natural lowering amount of the hoist cylinder is measured in accordance with the vessel angle after a first setting time after the stopping of the vessel lift-up signal and the vessel angle after a second setting time, and the measured lowering amount is inputted into the management controller 40.

The performance data of the various components measured in the manner mentioned above is transmitted to a personal computer or other data processing means such as checker installed to a portion apart from the dump truck through the communication means 41 and stored therein together with the year, month, date and time of the measuring, total operation (working) time of the engine, total travelling distance of the truck, and the like.

The performance data thus stored is compared with normal values, and in a case where the performance date does not accord with the normal value, this fact is displayed on a display means.

The storage and comparison processes mentioned above may be performed on the truck body by means of the management controller 40 or the like. In such case, when the measured performance data does not accord with the normal value, this fact is displayed and this display is transmitted to a remote place through the communication means 41.

In the embodiment mentioned above, although the engine controller 2, the speed changing mechanism controller 13, the brake controller 26, the actuator controller 30 and the management controller 40 are mentioned as independent means, respectively, these controllers may be assembled in one unit controller or as controller unit.

Furthermore, in the embodiment mentioned above, although the management controller 40 generates the measurement signals and the other respective controllers generate control signals to make components in the states satisfying the measurement conditions in accordance with the measurement signals from the management controller 40, it may be possible for the management controller 40 to generate a control signal to make components in the states satisfying the measurement conditions together with the generation of the measurement signals.

The embodiment of the present invention mentioned above will be applicable, without limiting to the dump truck described herein, to the measurement of the performance data of a construction machine such as bulldozer, hydraulic power shovel, or the like.

Another embodiment of the present invention will be described hereunder for measuring performance data of components of a bulldozer with reference to FIGS. 3 to 6.

Figure 3:
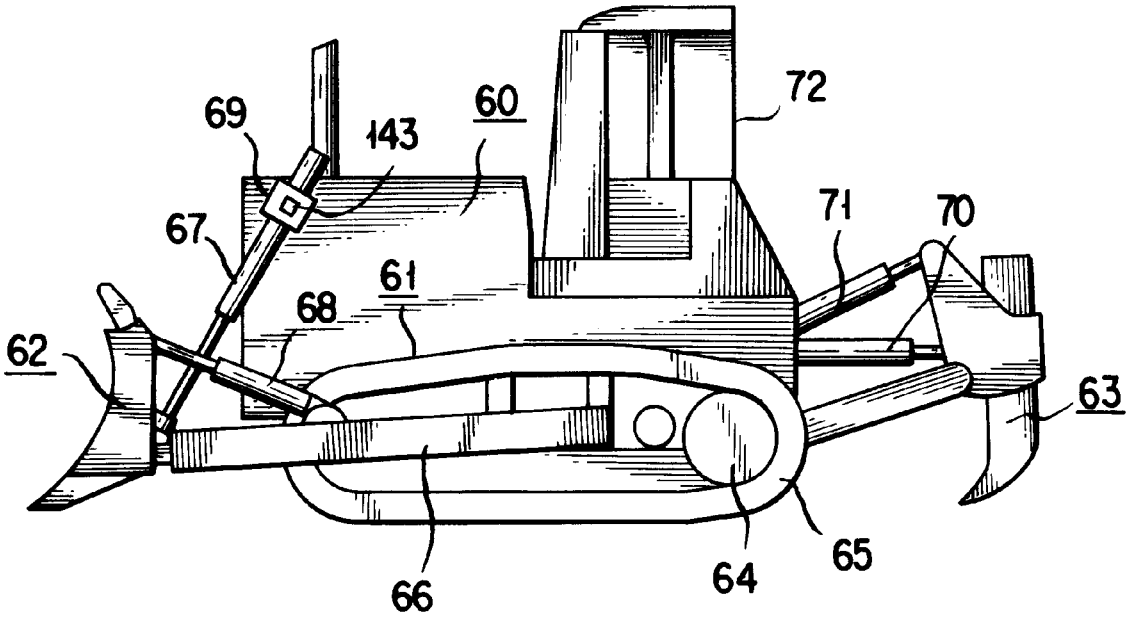
FIG. 3 is a schematic side view of a bulldozer to which the present invention is applicable.

FIG. 3 shows an illustrated side view of a bulldozer to which the present invention is applicable. The bulldozer has a vehicle body 60 to which a lateral pair of crawler-type travelling members 61, a blade 62 and a ripper 63 are provided. The crawler-type travelling member 61 includes a crawler 65 driven and rotated by a sprocket 64. A lateral pair of frames 66 are mounted to both sides of the vehicle body to be vertically swingable by means of a lateral pair of blade lifting cylinders 67, which are mounted to the vehicle body 60 to be swingable by means of a pair of yokes 69, and the blade 62 is supported by the frames 66 to be swingable in the longitudinal direction (running direction) of the bulldozer by means of a lateral pair of blade tilting cylinders 68.

The ripper 63 is supported by means of a ripper lifting cylinder 70 to be vertically swingable and also supported by means of ripper tilting cylinder 71 to be swingable in the longitudinal direction of the vehicle body 60.

The vehicle body 60 is provided with an operation chamber 72, i.e. driver's room, in which a deceleration pedal, a blade operation lever, a ripper operation lever, a traveling operation lever and a dial setting the engine rotation number, which will be mentioned hereinlater, are arranged.

Figure 4:
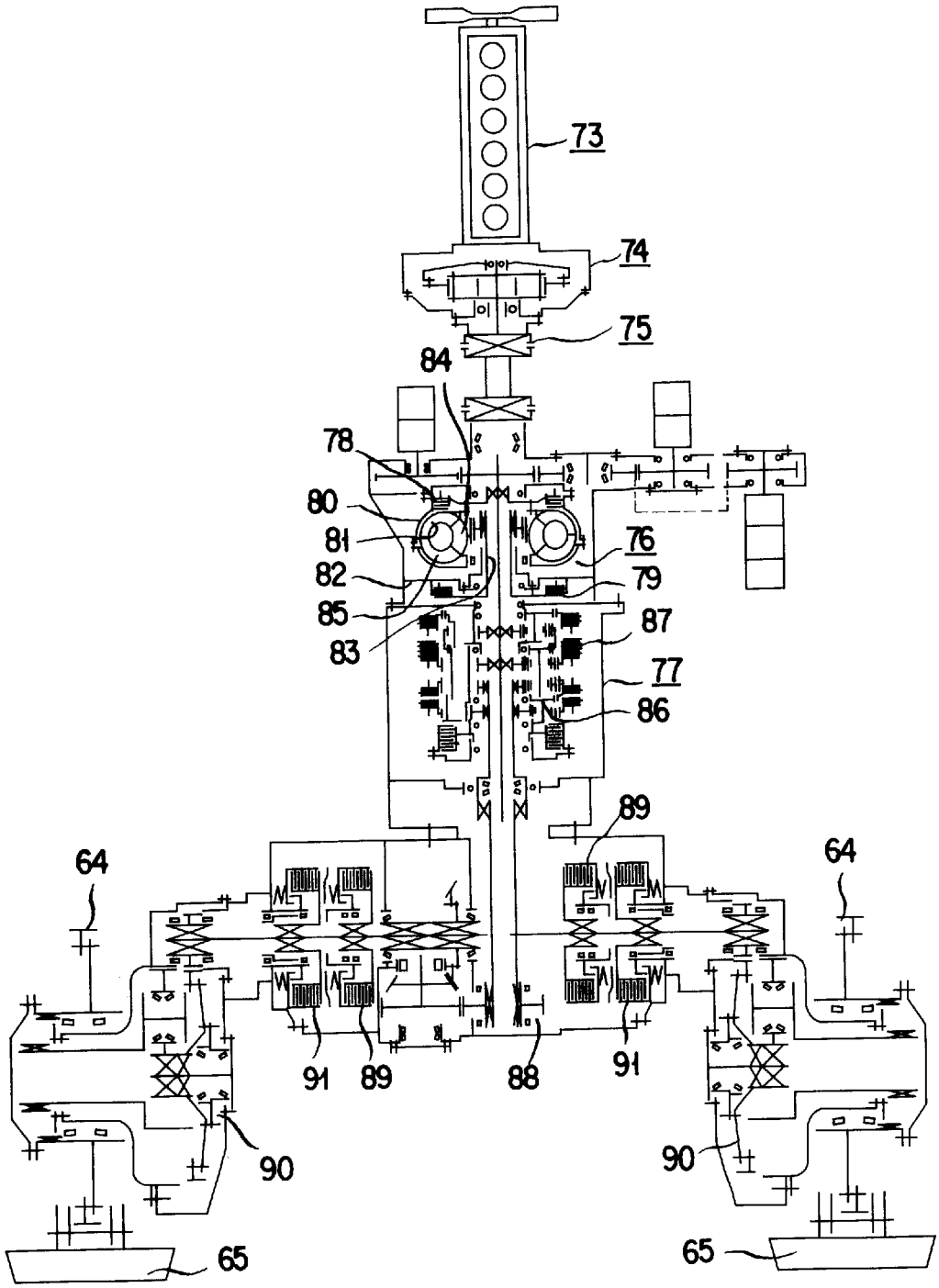
FIG. 4 is a schematic view showing a power transmission mechanism of the bulldozer.

FIG. 4 represents an arrangement of a power transmission system, in which a power generated by the operation of an engine 73 is transmitted to a torque converter 76 through a universal joint 75 while a twisting vibration being attenuated by means of damper 74. The torque converter 76 operates to transmit the power from the engine 73 to a speed changing mechanism 77 through hydraulic means such as oil in response to a variation of load. The torque converter 76 is equipped with a lock-up clutch 78 and a stator clutch 79.

In the state of "engagement (connect)" of the lock-up clutch 78, a drive case 80 and a turbine 81 is connected to one unit, and on the other hand, in the state of "disengagement (disconnect)" of the stator clutch 79, a rear housing 82 and a stator shaft 83 is separated (disengaged) from each other and a stator 84 is rotated together by the rotations of a pump 85 and the turbine 81. According to such operations, the power from the engine 73 is directly transmitted to the speed changing mechanism 77 without using any hydraulic means such as oil.

In the state of "disengagement" of the lock-up clutch 78, the drive case 80 and the turbine 81 is disconnected from each other, and on the other hand, in the state of "engagement" of the stator clutch 79, the rear housing 82 and the stator shaft 83 is connected thereby to fix the stator 84, which then attains a usual torque converter function. According to such operations, the power from the engine 73 is transmitted to the speed changing mechanism 77 through the hydraulic means such as oil.

The speed changing mechanism 77 is composed of a plurality of planetary gears 86 and two hydraulic clutches 87, which are selectively operated to be engaged or disengaged in one speed stage.

The speed changing mechanism 77 is provided, for example, with a forward clutch, a backward clutch, a first speed gear clutch, a second speed gear clutch and a third speed gear clutch and is operated at the forward first, second or third speed stage by making either one of the first, second and third speed gear clutches in an engaging state while maintaining the engaging state of the forward clutch. On the other hand, the speed changing mechanism 77 is also operated at the backward first, second or third speed stage by making either one of the first, second and third speed gear clutches in an engaging state while maintaining the engaging state of the backward clutch.

The output rotation of the speed changing mechanism 77 is transferred to a lateral pair of steering gears 89 through a transfer mechanism 88 and then to a lateral pair of sprockets 64 through final drive mechanisms 90. Further, in FIG. 4, reference numeral 91 denotes a lateral pair of steering brakes.

Figure 5:
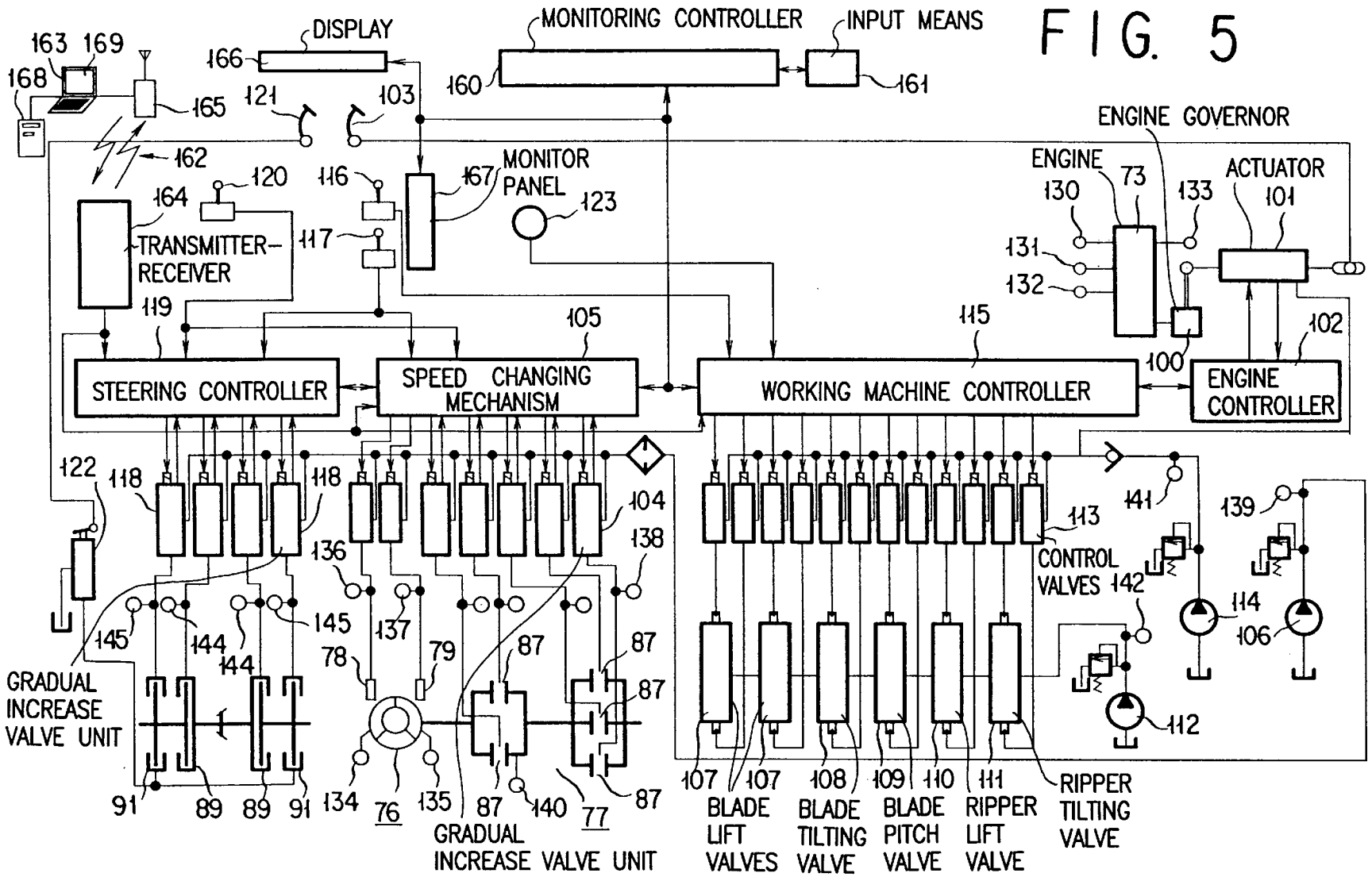
FIG. 5 is block diagram showing an arrangement of a measuring apparatus according to the present invention.
Figure 6:
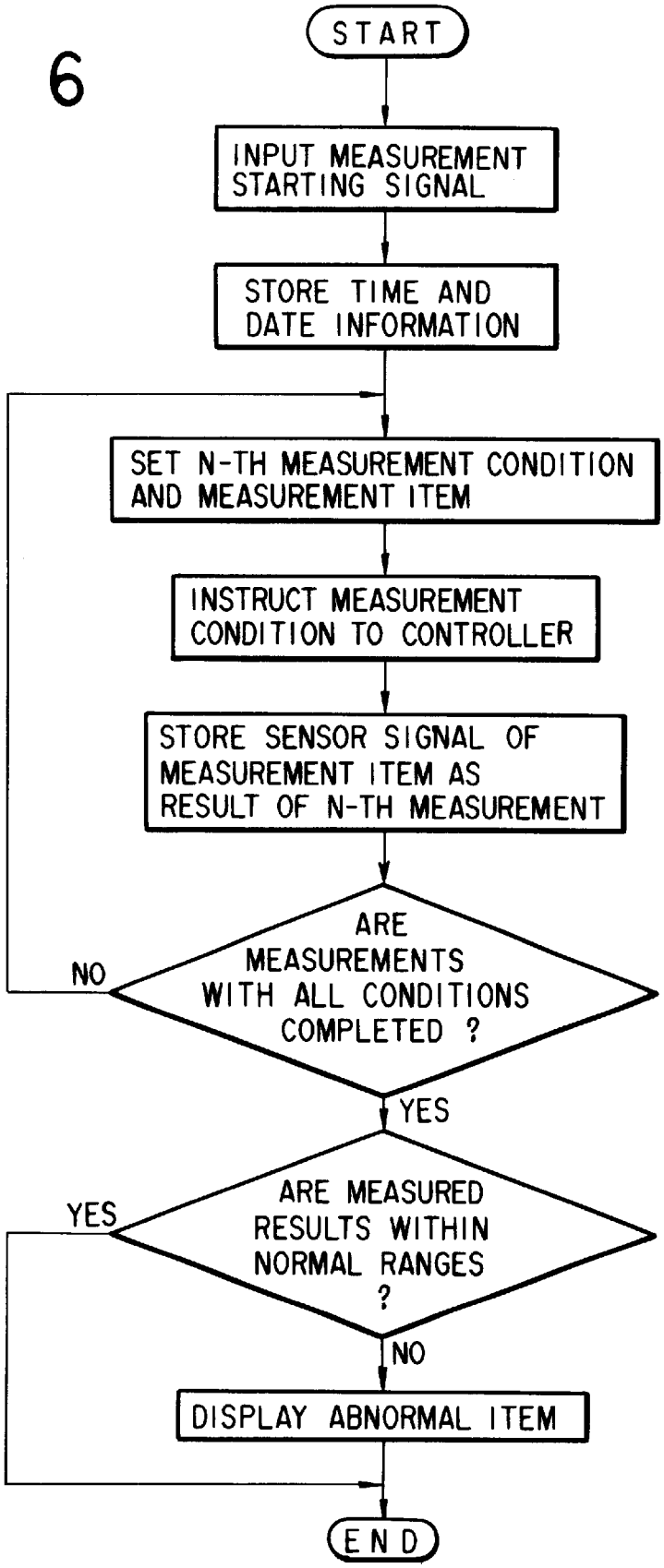
FIG. 6 is a flow chart explaining measuring procedures in the use of the arrangement of FIG. 5.

With reference to FIG. 5, the rotation number of the engine 73 is controlled by an engine governor 100, which is driven by an actuator 101, and this actuator 101 is electrically operated by an engine controller (governor controller) 102 and also mechanically operated by a deceleration pedal 103.

The lock-up clutch 78 and the stator clutch 79 of the torque converter 76 and the clutch 87 of the speed changing mechanism 77 take the "engaging" states by the supply of pressurized oil through electromagnetic gradual increase valve unit 104. The electromagnetic gradual increase valve unit 104 is electrically controlled by a speed changing mechanism 105. The electromagnetic gradual increase valve unit 104 operates to supply the drain pressurized oil of a hydraulic pump 106 through the current conduction thereto and, at this time, the pressure of the hydraulic pump 106 is gradually increased to the set pressure. For example, the electromagnetic gradual increase valve unit 104 is provided with an electromagnetic open/close valve, and a gradual increase valve and is operated to be opened by the current conduction to a solenoid of the electromagnetic open/close valve, and the output pressure therefrom is gradually increased to the set pressure with a predetermined time interval by the operation of the increase valve.

The lateral pair of blade lift cylinders 67; one of the lateral pair of blade tilting cylinders 68; the ripper lift cylinder 70; and the ripper tilting cylinder 71 are supplied with a drain pressurized oil from a hydraulic pump 112 for a working machine by a lateral pair of blade lift valves 107; a blade titling valve 108 and a blade pitch valve 109; a ripper lift valve 110; and a ripper tilting valve 111, respectively.

These valves mentioned above are pilot-pressure operation type valves which are switched by pilot pressure supplied to pressure receiving portions, to which a drain pressure from a hydraulic pump 114 for the pilot valve is supplied by means of electromagnetic proportional pressure control valves 113, and the solenoids of these control valves 113 are subjected to the current conduction control by a working machine controller 115.

To the working machine controller 115, are inputted various blade operation signals and various ripper operation signals from a blade operation lever 116 and a ripper operation lever 117, respectively, and the working machine controller 115 electrically energizes the solenoids of the electromagnetic proportional pressure control valves 113 corresponding to these operation signals.

The lateral pair of steering clutches 89 and steering brakes 91 keep the engaging state and the unbraked state, respectively, at a normal stage, and at a time when the pressurized oil is supplied by the electromagnetic gradual increase valve unit 118, the lateral pair of steering clutches 89 and steering brakes 91 take the disengaging state and braked state, respectively. The electromagnetic gradual increase valve unit 118 including a plurality of valves has substantially the same structure as that of the electromagnetic gradual increase valve unit 104, and the solenoids of the respective gradual valve units are subjected to the current conduction control by a steering controller 119.

The speed changing mechanism controller 105 and the steering controller 119 are inputted with various signals form a traveling control lever 120. The traveling control lever 120 is swingable in the lateral and longitudinal directions of the vehicle body and generates signals corresponding to the swinging direction and amount. For example, when the traveling lever 120 is swung forward, a forward (advance) signal is generated, and according to the swinging amount, one of the first, second or third speed stage signal is generated. On the other hand, when the traveling lever 120 is swung backward, a backward signal is generated, and according to the swinging amount, one of first, second or third speed stage signal is generated.

Further, when the traveling control lever 120 is swung in one of lateral directions by a certain amount, a signal for disengaging one of lateral steering clutches is generated, and when further swung in this direction, a signal for braking one of lateral steering brakes is generated. On the contrary, when the traveling control lever 120 is swung in the other one of lateral directions by a certain amount, a signal for disengaging the other one of lateral steering clutches is generated, and when further swung in this direction, a signal for braking the other one of lateral steering brakes is generated.

When a braking pedal 121 is operated, an auxiliary valve 122 brakes the lateral steering brakes 91 which are mechanically switched. A dial 123 is for setting the engine rotation number, and a signal representing the engine rotation number set by the dial 123 is inputted into the engine controller 102 through the working machine controller 115. The engine controller 102 operates the actuator 101 in response to the engine rotation number signal generated therefrom and also operates the engine governor 100 to set the engine 73 to be operative at the set rotation number.

The engine 73 is operatively connected to an engine rotation sensor 130 for detecting the engine rotation speed, a blow-by pressure sensor 131 for detecting the blow-by pressure, an engine oil pressure sensor 132 for detecting the pressure of the engine lubricant oil, and an exhaust gas temperature sensor 133 for detecting the engine exhaust gas temperature.

The torque converter 76 is operatively connected to an inlet oil pressure sensor 134 for detecting an inlet oil pressure, an outlet oil pressure sensor 135 for detecting an outlet oil pressure, a lock-up oil pressure sensor 136 for detecting an oil pressure of the lock-up clutch, and a stator oil pressure sensor 137 for detecting an oil pressure of the stator clutch.

The speed changing mechanism 77 is operatively connected to a gradual increase oil pressure sensor 138 for detecting output pressures of the respective valves of the electromagnetic gradual increase valve unit 104, an oil pressure sensor 139 for detecting a drain pressure of the hydraulic pump 106, and a lubricant oil pressure sensor 140 for detecting the lubricant oil pressure of the speed changing mechanism 77.

The arrangement of the present exemplary embodiment further includes a pilot oil pressure sensor 141 for detecting a drain pressure of the pilot hydraulic pump 114, a working oil pressure sensor 142 for detecting the working hydraulic pump 112, a yoke swing angle sensor 143 for detecting the swinging angle of the yoke 69, a steering clutch oil pressure sensor 144 for detecting the lateral steering clutches 89, and a steering brake oil pressure sensor 145 for detecting the lateral steering brakes 91.

In the described embodiment, the steering clutches 89 become the engaging state by means of spring and become the disengaged state by means of hydraulic force. The steering brakes 91 become the braked state by means of spring and become the released state by means of hydraulic force. The steering clutch oil pressure sensor 144 and the steering brake oil pressure sensor 145 act as pressure switches so as to take "High" state in response to set pressure and "Low" state in response to reservoir pressure, respectively.

The measurement data detected by the above respective sensors, i.e. the performance data of the respective components such as engine, torque converter, speed change mechanism, steering clutches, steering brakes, blade, etc., are inputted into a monitoring controller 160, respectively.

The monitoring controller 160 includes a storage (memory) means into which a plurality of measurement signals (constituting measurement signals corresponding to means detecting one or more than one performance data), control signals (aiming to realize, on the vehicle, measurement conditions relating to the vehicle conditions according to the measurement signals) corresponding to the respective measurement signals, and identification signals for the vehicle of a bulldozer to which the monitoring controller 160 is mounted (for example, type of the vehicle body, serial number of the vehicle body, type of the engine, engine serial number, optionally set vehicle number, etc.). Furthermore, in the above memory means, year, month, date and time of the measuring, total working time of engine, measurement conditions, component performance data measured by respective measurement conditions, and a measurement completion signal are stored, which will be described hereinbelow.

A measurement starting signal is inputted into the monitoring controller 160 from an input means 161, which uses a touch screen (a system performing an inputting operation through finger touch to an image screen, as shown in "Handy Reference to Computing Terms" written by Mitsuo TAKAHASHI, published by NATSUME SHA on 1989). Although, on the screen, measurement conditions and measured data can be displayed together with the measurement starting signal inputting, this inputting means is not limited to such touch screen. The monitoring controller 160 is further accommodated with a clock means, calendar function, and a function for detecting the total engine working time by a service meter in the bulldozer, and accordingly, when the measurement starting signal is inputted, the year, month, day and time of the inputting time and the engine total working time at that time are stored in the memory means in the monitoring controller 160.

The monitoring controller 160 generates control signals to the engine controller 102, the speed changing mechanism controller 105, the working machine controller 115 and the steering controller 119 in accordance with the measurement conditions stored in the memory means accommodated in the monitoring controller 160, and these respective controllers create the states according with the measurement conditions of the engine, torque converter, speed changing mechanism, steering clutches, brakes and blade through the actuator electrically changing the conditions in response to the control signals and read the performance data of the respective components detected by the sensors arranged in the bulldozer continuously with a time interval of about 10 m.sec. With the performance data relating to the time measurement, a time at which the initial measurement has been completed is judged as the measurement completing time, and the above mentioned measurement conditions and the thus measured time are stored in the memory means of the monitoring controller 160. With the performance data other than the time measurement, it is judged that the measured data is in a stable condition at a time when the variation amounts of the respective data continuously inputted become zero (0) value, and the above mentioned measurement conditions and the finally inputted measurement data are stored in the memory means. Further, it may be possible to preliminarily set and store the values, without making zero threshold values for the stable condition judgement, and to refer to the values thereafter at the measuring time. Upon the completion of the storage of the performance data with one measurement condition, the performance data is then stored with the next measurement condition. When the performance data of the components have been completed with the all measurement conditions, the measurement completion signal is stored. At this time, the contents stored in the memory means concerning the measurement having the N-sets of measurement conditions are, in order, inputting time (year, month, day, time), engine total working time, first measurement condition, first measurement data, - - - , N-th measurement condition, N-th measurement data, and measurement completion signal.

Next, the monitoring controller 160 transmits the contents stored in the memory means concerning the measurement having the N-sets of the measurement conditions to a data processing means 163 by a communication means 162, adding a signal for initially identifying the measurement data transmission to the data processing means 163. The signal for identifying the measurement data transmission to the data processing means 163 includes a vehicle identification signal for the vehicle now operated (for example, type of vehicle).

The communication means 162 includes a vehicle body side transmitter-receiver (radio control receiver) 164 provided to the vehicle body and a remote side transmitter-receiver 165 in association with the data processing mentioned above and performs a telemetering through the transmission-receive operation by means of a communication satellite. The reason why the communication satellite is used is for ensuring the stability of the transmission-receive operation.

The measurement completion signal is identified as the transmission-receive completion signal by means of the monitoring controller 160 and the data processing means 163. The data processing means 163 is connected to a memory means 168 in operative association therewith in which are preliminarily stored the measurement conditions set, for example, respective vehicle types in the vehicle identification signals, measurement items corresponding to these measurement conditions, and threshold values each set for the respective measurement items. The threshold values have areas of performance values, i.e. normal values, under the measurement conditions which do not require any repair or exchanging of the respective components of the vehicle. With respect to contents of the measurement conditions of the same type of vehicles, the measurement items corresponding to the measurement conditions and threshold values (normal values) respectively set to the measurement items, if exists, it is a matter of course that the content stored in the memory means 168 associated with the data processing means 163 and the contents stored in the memory means accommodated in the monitoring controller 160 are coincident with each other. The transmission data, i.e. the vehicle identification signal, the measurement time (year, month, day, time), total engine working time, groups of measurement conditions and the performance data measured under the above-mentioned respective measurement conditions, which are transmitted from the vehicle body side transmitter-receiver 164 to the data processing means 163 through the remote side transmitter-receiver 165, are stored in the memory means 168 associated with the data processing means 163.

The data processing means 163 reads from the memory means associated therewith, the threshold value (normal value) corresponding to the vehicle identification signal in the above-mentioned transmission data and compares it with the performance data corresponding to the threshold value. In such comparison, the data processing means 163 judges to be abnormal at a time when the performance data differs from the corresponding threshold value, and in such case, this abnormal state is displayed on a display means such as display 166 or monitor panel 167 mounted to the vehicle body through the communication means 162 and the monitoring controller 160. This abnormal condition may be displayed on a display means 169 associated with the data processing means 163, and it may be also possible that the threshold value is stored in the memory means associated with the monitoring controller in the vehicle body and the judgement of the abnormal condition is made by the monitoring controller 160.

By periodically inputting the above-mentioned measurement starting signals (for example, about every 720 hours time interval in the total engine working time), the measurement data obtained with time intervals under specified measurement conditions prescribed by the above-mentioned measurement conditions concerning the specific vehicle are stored in the memory means 168 associated with the data processing means 163. The data processing means 163 processes in time series the measurement data stored in the memory means and estimates an overhaul time, part exchanging time or the like time by a method or means disclosed in, for example, the Japanese Patent Laid-open Publication (KOKAI) HEI 10-273920. And, the measurement data treated by the apparatus of the present invention is the data obtained under the same conditions, that is, the data obtained by making the measurement data forcibly coincident with the same vehicle conditions at the measurement time, so that the measurement data according to the present invention has high reliability as data for analyzing variation in elapsing time. Furthermore, since the time required for the measurement can be extremely reduced in comparison with the case of manual setting or measurement of the vehicle conditions at the measuring time, the measurement conditions and the measuring items can be easily widened in a range of measuring time in an actually allowable state, and as a result, the number of data of variation in time elapsing to be analyzed can be increased, and hence, to improve the performance or accuracy of the analysis.

One example of the measuring working according to the above embodiment of the present invention will be described hereunder.

An operator for performing the measurement operates the input means (touch screen) 161 to input the measurement starting signal to the monitoring controller 160. Then, the monitoring controller 160 generates a first measurement signal concerning the measuring sensor and a control signal making the component to take a state satisfying a first measurement condition corresponding to the first measurement signal.

According to this operation, the components take the state satisfying the first measurement conditions, and under this state, the measured values by the sensors to be measured are stored. When the measured value is stabled, it is judged that the measurement has completed and the monitoring controller 160 then generates a second measurement signal and a control signal making the component to take a state satisfying a second measurement condition. In substantially the same manner, the monitoring controller 160 sequentially generates seventeen measurement signals and control signals making the component to take states satisfying seventeen measurement conditions, and the seventeen kinds of performance data with the seventeen measurement conditions are thereby measured and stored.

When all the measurements has been completed, the stored performance data, the measurement time (year, month, day, time), total engine working time, and vehicle identification signal of a bulldozer are transmitted to the data processing means 163, in which the data processing and the display of abnormal condition are performed as mentioned hereinbefore. These operations will be represented by the flow chart of FIG. 6.

The relationship between the measurement conditions and measuring sensors will be described hereunder.

At the time of the first measurement condition, there are generated the engine idling signal, the speed changing mechanism neutral signal, the torque converter function signal, the steering clutch engagement signal, the steering brake unbraking signal and the blade stopping signal.

In response to these signals, the engine 73 takes the idling state (low speed rotation), the speed changing mechanism 77 takes the neutral state, the torque converter 76 takes its functional state under the state that the lock-up clutch 78 is disengaged and the stator clutch 79 is engaged, the steering clutch 89 is engaged and the steering brake 91 takes the unbraking state.

The following sensors are operated to carry out the measurement in response to the first measurement signal, that is, the engine rotation sensor 130, the engine oil pressure sensor 132, the inlet oil pressure sensor 134, the outlet oil pressure sensor 135, the lock-up oil pressure sensor 136, the stator oil pressure sensor 137, gradual increase oil pressure sensor 138, the oil pressure sensor 139, the pilot oil pressure sensor 141, the steering clutch oil pressure sensor 144, and the steering brake oil sensor 145. These sensors always perform the measurements, and the measuring sensor in this disclosure means a sensor by which the measured value is inputted into the monitoring controller 160 to store the same therein.

In the case mentioned above, the judgement whether the respective measurement conditions are abnormal or normal is done in the following manner.

Engine rotation number: Normal at 600–700 rpm.

Engine lubrication oil pressure: Normal at more than 0.8 $kg/cm^2$

Inlet oil pressure: Normal at 1.0–3.0 $kg/cm^2$

Outlet oil pressure: Normal at 0.5–2.5 $kg/cm^2$

Lock-up clutch oil pressure: Normal at zero value

Stator clutch oil pressure: Normal at 23.0–27.0 $kg/cm^2$

Clutch oil pressure: Normal at 20.0–26.0 $kg/cm^2$

Hydraulic pump discharge pressure: Normal at 10.0–15.0 $kg/cm^2$

Pilot oil pressure: Normal at 24.0–32.0 $kg/cm^2$

Steering clutch oil pressure sensor 144: Normal at low value

Steering brake oil pressure sensor 145: Normal at high value

At the time of the second measurement condition, there are generated the engine idling signal, the speed changing mechanism neutral signal, the torque converter function signal, the steering clutch-disengagement signal, the steering brake braking signal and the blade stopping signal.

In response to these signals, the engine 73 takes the idling state (low speed rotation), the speed changing mechanism 77 takes the neutral state, the torque converter 76 takes its functional state under the state that the lock-up clutch 78 is disengaged and the stator clutch 79 is engaged, the steering clutch 89 is engaged and the steering brake 91 takes the braking state.

The following sensors are operated to carry out the measurement in response to the second measurement signal, that is, the gradual increase oil pressure sensor 138, the steering clutch oil sensor 144 and the steering brake oil pressure sensor 145.

In the case mentioned above, the judgement whether the respective measurement conditions are abnormal or normal is done in the following manner.

Clutch oil pressure: Normal at 20.0–26.0 kg/cm$^2$

Steering clutch oil pressure sensor 144: Normal at high value

Steering brake oil pressure sensor 145: Normal at low value

At the time of the third measurement condition, there are generated the engine idling signal, the speed changing mechanism forward first speed stage signal, the torque converter function signal, the steering clutch-disengagement signal, the steering brake braking signal and the blade stopping signal.

In response to these signals, the engine 73 takes the idling state (low speed rotation), the speed changing mechanism 77 takes the forward first speed stage state, the torque converter 76 takes its functional state under the state that the lock-up clutch 78 is disengaged and the stator clutch 79 is engaged, the steering clutch 89 is disengaged, and the steering brake 91 takes the braking state.

The gradual increase oil pressure sensor 138 is operated to carry out the measurement in response to the third measurement signal, and the pressure gradually increasing time interval is calculated in accordance with the time when the measurement pressure by the gradual increase oil pressure sensor 138 increases to the pressure to be measured.

In the case mentioned above, the judgement whether normal or abnormal is done such as:

Clutch oil pressure: Normal at 20.0–26.0 kg/cm$^2$

Gradually increasing time: Normal at 1.0–1.6 second

At the time of the fourth measurement condition, there are generated the engine idling signal, the speed changing mechanism forward second speed stage signal, the torque converter function signal, the steering clutch-disengagement signal, the steering brake braking signal and the blade stopping signal.

In response to these signals, the engine 73 takes the idling state (low speed rotation), the speed changing mechanism takes the forward second speed stage state, the torque converter 76 takes its functional state under the state that the lock-up clutch 78 is disengaged and the stator clutch 79 is engaged, the steering clutch 89 is disengaged, and the steering brake 91 takes the braking state.

The gradual increase oil pressure sensor 138 is operated to carry out the measurement in response to the fourth measurement signal, and the pressure gradually increasing time interval is also calculated in the manner mentioned above.

In the case mentioned above, the judgement whether normal or abnormal is done as follows:

Clutch oil pressure: Normal at 20.0–26.0 kg/cm$^2$

Gradually increasing time: Normal at 0.9–1.5 second

At the time of the fifth measurement condition, there are generated the engine idling signal, the speed changing mechanism forward third speed stage signal, the torque converter function signal, the steering clutch-disengagement signal, the steering brake braking signal and the blade stopping signal.

In response to these signals, the engine 73 takes the idling state (low speed rotation), the speed changing mechanism takes the forward third speed stage state, the torque converter 76 takes its functional state under the state that the lock-up clutch 78 is disengaged and the stator clutch 79 is engaged, the steering clutch 89 is disengaged, and the steering brake 91 takes the braking state.

The gradual increase oil pressure sensor 138 is operated to carry out the measurement in response to the fifth measurement signal, and the pressure gradually increasing time interval is also calculated in the manner mentioned above.

In the case mentioned above, the judgement whether normal or abnormal is done as follows:

Clutch oil pressure: Normal at 20.0–26.0 kg/cm$^2$

Gradually increasing time: Normal at 0.9–1.5 second

At the time of the sixth measurement condition, there are generated the engine idling signal, the speed changing mechanism backward first speed stage signal, the torque converter function signal, the steering clutch-disengagement signal, the steering brake braking signal and the blade stopping signal.

In response to these signals, the engine 73 takes the idling state (low speed rotation), the speed changing mechanism 77 takes the backward first speed stage state, the torque converter 76 takes its functional state under the state that the lock-up clutch 78 is disengaged and the stator clutch 79 is engaged, the steering clutch 89 is disengaged, and the steering brake 91 takes the braking state.

The gradual increase oil pressure sensor 138 is operated to carry out the measurement in response to the sixth measurement signal, and the pressure gradually increasing time interval is also calculated in the manner mentioned above.

In the case mentioned above, the judgement whether normal or abnormal is done such as:

Clutch oil pressure: Normal at 20.0–26.0 kg/cm$^2$

Gradually increasing time: Normal at 1.2–1.9 second

At the time of the seventh measurement condition, there are generated the engine idling signal, the speed changing mechanism neutral signal, the torque converter function signal, the steering clutch-disengagement signal, the steering brake braking signal and the blade pitch-back signal.

In response to these signals, the engine 73 takes the idling state (low speed rotation), the speed changing mechanism 77 takes the neutral state, the torque converter 76 takes its functional state under the state that the lock-up clutch 78 is disengaged and the stator clutch 79 is engaged, the steering clutch 89 is disengaged, the steering brake 91 takes the braking state, and the blade 62 is in its pitch-back state. The term "pitch-back" means to perform a tilting operation to tilt the blade 62 to the vehicle body side by contracting the lateral blade tilting cylinders 68.

The working oil pressure sensor 142 is operated to carry out the measurement in response to the seventh measurement signal. In the case mentioned above, when the drain pressure of the hydraulic pump 112 of the working machine is in a range of 180–210 kg/cm$^2$, the operation is judged to be normal.

At the time of the eighth measurement condition, there are generated the engine idling signal, the speed changing mechanism neutral signal, the torque converter function signal, the steering clutch disengagement signal, the steering brake braking signal and the blade lift-up signal.

In response to these signals, the engine 73 takes the idling state (low speed rotation), the speed changing mechanism 77 takes the neutral state, the torque converter 76 takes its functional state under the state that the lock-up clutch 78 is disengaged and the stator clutch 79 is engaged, the steering clutch 89 is disengaged, the steering brake 91 takes the braking state, and the blade 62 is lifted up to its uppermost position.

The yoke angle sensor 143 operated to carry out the measurement in response to the eighth measurement signal. In the case mentioned above, a time interval between a time at which the measurement value of the yoke angle sensor 143 starts to vary and a time at which this variation is stopped, that is, a time interval when the blade 62 is lifted up to its uppermost position from the position contacting to the ground, is calculated. In the case where the calculated lifting time is in a range of 13.0–21.0 seconds, the operation is judged to be normal.

At the time of the ninth measurement condition, there are generated the engine full-operation signal, the speed changing mechanism neutral signal, the torque converter function signal, the steering clutch engagement signal, the steering brake unbraking signal and the blade stopping signal.

In response to these signals, the engine 73 takes the full operating state (high speed rotation), the speed changing mechanism 77 takes the neutral state, the torque converter 76 takes its functional state under the state that the lock-up clutch 78 is disengaged and the stator clutch 79 is engaged, the steering clutch 89 is engaged, the steering brake 91 takes the unbraking state.

The following sensors are operated to carry out the measurement in response to the ninth measurement signal, that is, the engine rotation sensor 130, the engine oil pressure sensor 132, the inlet oil pressure sensor 134, the outlet oil pressure sensor 135, the gradual increase oil pressure sensor 138, the oil pressure sensor 139, the lubrication oil pressure sensor 140, the pilot oil pressure sensor 141, the steering clutch oil pressure sensor 144, and the steering brake oil sensor 145.

In the case mentioned above, the judgement whether the respective measurement conditions are abnormal or normal is done in the following manner.

Engine rotation number: Normal at 1300–2030 rpm.

Engine lubrication oil pressure: Normal at more than 2.3–3.7 kg/cm$^2$

Inlet oil pressure: Normal at 7.5–10.0 kg/cm$^2$

Outlet oil pressure: Normal at 5.5–8.0 kg/cm$^2$

Clutch oil pressure: Normal at 22.0–27.0 kg/cm$^2$

Hydraulic pump discharge pressure: Normal at 11.0–16.0 kg/cm$^2$

Lubrication oil pressure: Normal at 0.8–1.8 kg/cm$^2$

Pilot oil pressure: Normal at 32.0–37.0 kg/cm$^2$

Steering clutch oil pressure sensor 144: Normal at low value

Steering brake oil pressure sensor 145: Normal at high value

At the time of the tenth measurement condition, there are generated the engine full-operation signal, the speed changing mechanism neutral signal, the torque converter function signal, the steering clutch disengagement signal, the steering brake braking signal and the blade stopping signal.

In response to these signals, the engine 73 takes the full operating state (high speed rotation), the speed changing mechanism takes the neutral state, the torque converter 76 takes its functional state under the state that the lock-up clutch is disengaged and the stator clutch is engaged, the steering clutch 89 is disengaged and the steering brake 91 takes the braking state.

The following sensors are operated to carry out the measurement in response to the tenth measurement signal, that is, the gradual increase oil pressure sensor 138, the steering clutch oil sensor 144 and the steering brake oil pressure sensor 145.

In the case mentioned above, the judgement whether the respective measurement conditions are abnormal or normal is done in the following manner.

Clutch oil pressure: Normal at 22.0–27.0 kg/cm$^2$

Steering clutch oil pressure sensor 144: Normal at high value

Steering brake oil pressure sensor 145: Normal at low value

At the time of the eleventh measurement condition, there are generated the engine full-operation signal, the speed changing mechanism neutral signal, the torque converter function signal, the steering clutch-disengagement signal, the steering brake braking signal and the blade lift-up signal.

In response to these signals, the engine 73 takes the full operating state (high speed rotation), the speed changing mechanism 77 takes the neutral state, the torque converter 76 takes its functional state under the state that the lock-up clutch 78 is disengaged and the stator 79 clutch is engaged, the steering clutch 89 is disengaged, the steering brake 91 takes the braking state, and the blade 62 is lifted up to its uppermost position.

The yoke angle sensor 143 is operated to carry out the measurement in response to the eleventh measurement signal, and the blade lift-up time is calculated in the manner mentioned hereinbefore. When the lift-up time is in a range of 4.5 to 6.0 seconds, the operation is judged to be normal.

At the time of the twelfth measurement condition, there are generated the engine full-operation signal, the speed changing mechanism neutral signal, the torque converter function signal, the steering clutch disengagement signal, the steering brake braking signal and the blade pitch dump signal.

In response to these signals, the engine 73 takes the full operating state (high speed rotation), the speed changing mechanism 77 takes the neutral state, the torque converter 76 takes its functional state under the state that the lock-up clutch 78 is disengaged and the stator clutch 79 is engaged, the steering clutch 89 is disengaged, the steering brake 91 takes the braking state, and the blade 62 takes the "pitch-dump" state. The term "pitch-dump" means a tilting operation in which the blade 62 is tilted from the pitch-state mentioned before to a position opposing to the vehicle body by extending the lateral blade tilting cylinders 68. According to this operation, the blade-lift cylinder 67 is swung with the yoke 69 being the fulcrum.

The yoke angle sensor 143 is operated to carry out the measurement in response to the twelfth measurement signal, and a time interval between a time at which the measured value of the yoke angle sensor 143 starts to vary to a time at which this variation stops is calculated. Then, the blade pitch-dump time is determined and in a case where this blade pitch-dump time is in a range of 5.8 to 7.0 seconds, the operation is judged to be normal.

At the time of the thirteenth measurement condition, there are generated the engine full-operation signal, the speed changing mechanism forward third speed stage signal, the torque converter function signal, the steering clutch disengagement signal, the steering brake braking signal and the blade stopping signal.

In response to these signals, the engine 73 takes the full operating state (high speed rotation), the speed changing mechanism 77 takes the third speed stage state, the torque converter 76 takes its functional state under the state that the lock-up clutch 78 is disengaged and the stator clutch 79 is engaged, the steering clutch 89 is disengaged, and the steering brake 91 takes the braking state.

The following sensors are operated to carry out the measurement in response to the thirteenth measurement signal, that is, the engine rotation sensor 130, the blow-by sensor 131, the exhaust gas temperature sensor 133, the inlet oil pressure sensor 134, the outlet oil pressure sensor 135, the gradual increase oil pressure sensor 138, the oil pressure sensor 139, the steering clutch oil pressure sensor 144, and the steering brake oil sensor 145.

In the case mentioned above, the judgement whether the respective measurement conditions are abnormal or normal is done in the following manner.

Engine rotation number: Normal at 1500–1680 rpm.

Blow-by pressure: Normal at less than 350 kg/cm$^2$

Exhaust gas temperature: Normal at less than 700° C.

Inlet oil pressure: Normal at 6.0–9.0 kg/cm$^2$

Outlet oil pressure: Normal at 3.5–6.5 kg/cm$^2$

Clutch oil pressure: Normal at 22.0–29.0 kg/cm$^2$

Steering clutch oil pressure sensor 144: Normal at high value

Steering brake oil pressure sensor 145: Normal at low value

At the time of the fourteenth measurement condition, there are generated the engine full-operation signal, the speed changing mechanism forward third speed stage signal, the torque converter function signal, the steering clutch disengagement signal, the steering brake braking signal and the blade pitch-back signal.

In response to these signals, the engine 73 takes the full operating state (low speed rotation), the speed changing mechanism 77 takes the third speed stage state, the torque converter 76 takes its functional state under the state that the lock-up clutch 78 is disengaged and the stator clutch 79 is engaged, the steering clutch 89 is disengaged, the steering brake 91 takes the braking state, and the blade 62 is in the pitch-back state.

The engine rotation sensor 130 and the working machine oil pressure sensor 142 are operated in response to the above fourteenth measurement signal.

In the case mentioned above, the judgement whether the respective measurement conditions are abnormal or normal is done in the following manner.

Engine rotation number: Normal at 1380–1500 rpm

Discharge pressure of hydraulic pump for working machine: Normal at 190–220 kg/cm$^2$ At the time of the fifteenth measurement condition, there are generated the engine 1800 rpm signal, the speed changing mechanism forward first speed stage signal, the torque converter lock-up signal, the steering clutch disengagement signal, the steering brake braking signal and the blade stopping signal.

In response to these signals, the engine 73 is rotated at 1800 rpm, the speed changing mechanism 77 takes the forward first speed stage state, the torque converter 76 takes its lock-up state under the state that the lock-up clutch 78 is engaged and the stator clutch 79 is disengaged, the steering clutch 89 is disengaged, and the steering brake 91 takes the braking state, and the blade 62 takes its braking state.

The lock-up oil pressure sensor 136 and the stator oil pressure sensor 137 are operated in response to the above fifteenth measurement signal.

In the case mentioned above, the judgement whether the respective measurement conditions are abnormal or normal is done in the following manner.

Lock-up oil pressure: Normal at 15.0–17.0 kg/cm$^2$

Stator oil pressure: Normal at zero value

At the time of the sixteenth measurement condition, there are generated the engine 1000 rpm signal, the speed changing mechanism neutral signal, the torque converter functional signal, the steering clutch disengagement signal, the steering brake braking signal and the blade stopping signal.

In response to these signals, the engine 73 is rotated at 1000 rpm, the speed changing mechanism 77 takes its neutral state, the torque converter 76 takes its functional state under the state that the lock-up clutch 78 is disengaged and the stator clutch 79 is engaged, the steering clutch 89 is disengaged, the steering brake 91 takes the braking state.

The lubrication oil pressure sensor 140 is operated by the sixteenth measurement signal, and the operation is judged to be "Normal" at the lubrication oil pressure of the speed changing mechanism of more than 0.1 kg/cm$^2$.

At the time of the seventeenth measurement condition, there are generated the engine 1000 rpm signal, the speed changing mechanism neutral signal, the torque converter functional signal, the steering clutch disengagement signal, the steering brake braking signal and the blade pitch dump signal.

In response to these signals, the engine 73 is rotated at 1000 rpm, the speed changing mechanism 77 takes its neutral state, the torque converter 76 is in functional state under the state that the lock-up clutch 78 is disengaged and the stator clutch 79 is engaged, the steering clutch 89 is disengaged, the steering brake 91 takes the braking state, and the blade 62 is in its pitch dump state.

The yoke angle sensor 142 is operated in response to the above seventeenth measurement signal, and in the case mentioned above, a time interval between a time at which the measurement value of the yoke angle sensor 142 starts to vary and a time at which this variation is stopped is calculated. This time interval is considered as pitch dump time, and in the case where this pitch dump time is in a range of 10.0–15.0 seconds, the operation is judged to be "Normal".

In the above operations, the measurement starting signals may be inputted from the remote portion by way of the communication means 162.

It is to be noted that, in a case where the dump truck of FIG. 1, the bulldozer of FIG. 3, and other construction machines or vehicles are worked in the same working area or site, the performance data concerning these dump truck, bulldozer, and other construction machines or vehicles may be respectively measured in the manner mentioned hereinbefore and the measured data are all sent to one common data processing unit to totally process and store the data thereby to concentrically control or manage the construction machines.

Further, it is self-evident to a person skilled in the art that although the present invention is described hereinbefore with reference to the exemplary embodiments, it is possible to make various changes, deletions and additions to the disclosed embodiment without departing from the subject and scope of the present invention. Accordingly, it is to be understood that the present invention is not limited to the described embodiments and includes scopes or its equivalent scope defined by the elements recited in the appended claims.

What is claimed is:

1. A method of measuring performance data of components of a construction machine comprising the steps of:

(i) automatically operating selected components of the construction machine so as to satisfy one of a plurality of measurement conditions which are preliminarily set;

(ii) automatically measuring performance data of the selected components while the selected components are automatically operated; and (iii) successively performing the steps (i) and (ii) with respect to all remaining measurement conditions other than said one measurement condition thereby to measure the performance data of the selected components with one or more than one of the measurement conditions;

wherein the selected components include only components relating to the respective measurement conditions.

2. A method of measuring performance data of components of a construction machine according to claim 1, wherein the measured performance data is sent to a remote place apart from the construction machine and an abnormal condition is displayed at the remote place at a time when the measured performance data is different from normal performance data.

3. A method of measuring performance data of components of a construction machine according to claim 1, wherein the measured data of components of one or more than one construction machine are sent to a remote place and the measured performance data of the components of the one or more than one construction machine are processed and stored in the remote place.

4. An apparatus for measuring performance data of components of a construction machine comprising:

detecting means for detecting performance data of the components of the construction machine;

storage means for storing plural sets of measurement signals for enabling the detecting means to detect the performance data of the components, and plural sets of control signals for realizing measurement conditions corresponding to the plural sets of measurement signals;

control means for: (i) outputting automatically and successively, to selected ones of the components, respective sets of the control signals for creating states for satisfying respective ones of the measurement conditions, (ii) outputting automatically and successively, to the detecting means, respective sets of the measurement signals to enable the detecting means to detect the performance data, and (iii) successively performing the outputting operations (i) and (ii) with respect to all remaining sets of measurement signals and control signals, when a measurement starting signal is inputted into the control means; and means for inputting the measurement starting signal to the control means;

wherein the selected components to which the control means outputs the control signals include only components relating to the respective measurement conditions.

5. An apparatus for measuring performance data of components of a construction machine according to claim 4, further comprising communication means for inputting the measurement starting signal to the control means from a remote place apart from the construction machine.

6. An apparatus for measuring performance data of components of a construction machine according to claim 4, further comprising data processing means judging an abnormality condition in a case where the performance data differs from normal performance data, and notification means for indicating the presence of the abnormality condition when the data processing means judges that the abnormality condition exists.

7. An apparatus for measuring performance data of components of a construction machine according to claim 4, further comprising:

communication means for transmitting and receiving the performance data to and from a remote place apart from the construction machine;

data processing means for processing the performance data received by the communication means into a form suitable for display;

means for displaying the performance data as processed by the data processing means; and means arranged in operative association with the data processing means for storing the performance data.

8. An apparatus for measuring performance data of components of a construction machine according to claim 7, further comprising data processing means judging an abnormality condition in a case where the performance data differs from normal performance data, and notification means for indicating the presence of the abnormality condition when the data processing means judges that the abnormality condition exists.

9. An apparatus for measuring performance data of components of a construction machine according to claim 7, wherein said communication means for transmitting and receiving the performance data to and from the remote place apart from the construction machine generates transmission data in combination with the performance data and data other than the performance data including at least one of vehicle identification number, measurement year, month, day and time, engine total working time and groups of measured conditions.

10. An apparatus for measuring performance data of components of a construction machine according to claim 9, wherein said transmission data comprises centralized management data of the construction machine.

11. An apparatus for measuring performance data of components of a construction machine according to claim 4, wherein said detecting means comprises a plurality of sensors.

12. An apparatus for measuring performance data of components of a construction machine according to claim 11, wherein the respective sets of the measurement signals are output automatically and successively to selected ones of the plurality of sensors.

* * * * *